US005782246A

United States Patent [19]

Axelrod

[11] Patent Number: 5,782,246

[45] Date of Patent: Jul. 21, 1998

[54] LONG FILLER CIGAR CONSTRUCTION

[76] Inventor: Herbert R. Axelrod, 6 Marine Pl., Deal, N.J. 07753

[21] Appl. No.: 566,256

[22] Filed: Dec. 1, 1995

[51] Int. Cl.[6] ..... A24D 1/00

[52] U.S. Cl. ..... 131/364

[58] Field of Search ..... 131/360, 364, 131/361, 362

[56] References Cited

U.S. PATENT DOCUMENTS

| | | | |
|---|---|---|---|
| 304,582 | 9/1884 | Thoss | 131/364 |
| 368,463 | 8/1887 | Farias | 131/364 |
| 435,510 | 9/1890 | Meyer | 131/364 |
| 437,328 | 9/1890 | Boehm | 131/364 |
| 451,302 | 4/1891 | Heilbroner | 131/364 |
| 456,312 | 7/1891 | Moonelis | 131/364 |
| 663,073 | 12/1900 | Coughtry | 131/364 |
| 683,453 | 10/1901 | Ertheiler | 131/364 |
| 1,223,362 | 4/1917 | Bock | 131/364 |
| 1,829,559 | 10/1931 | Gilliam | 131/364 |
| 4,203,453 | 5/1980 | Leclerc et al. | 131/364 |
| 4,319,592 | 3/1982 | Leclerc et al. | 131/364 |
| 4,793,367 | 12/1988 | Brackmann | 131/364 |

*Primary Examiner*—Aaron J. Lewis
*Assistant Examiner*—Charles W. Anderson
*Attorney, Agent, or Firm*—Fulwider Patton Lee & Utecht, LLP

[57] ABSTRACT

A cigar construction utilizing a plurality of rolled-together long filler cigar leaves with the front ends of the tubes extending from the front of the cigar to provide immediate smoker identification of the integrity of the long filler leaf construction.

2 Claims, 1 Drawing Sheet

FIG. 1
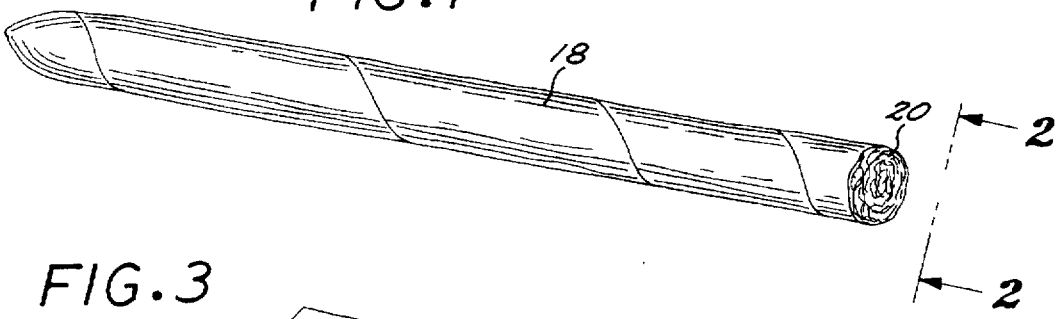
FIG. 3
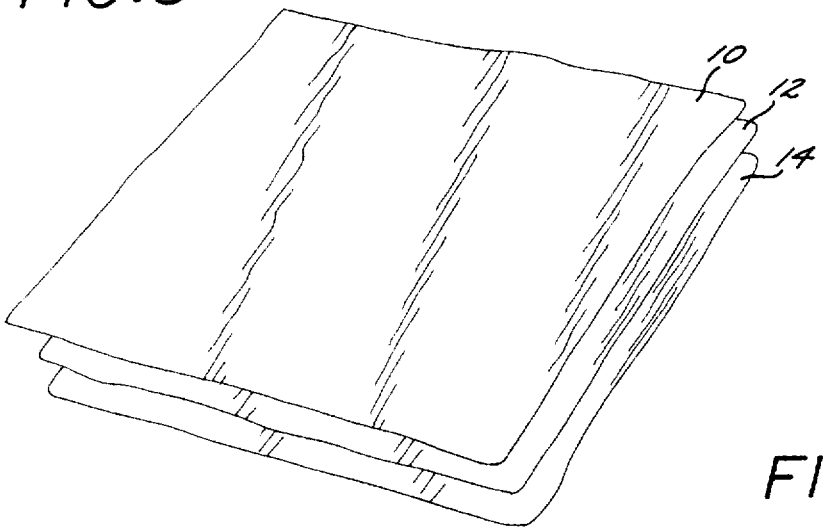
FIG. 2
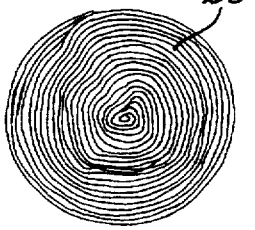
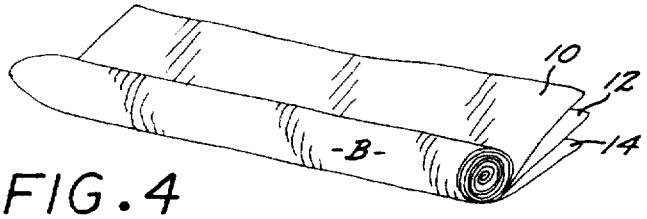
FIG. 4
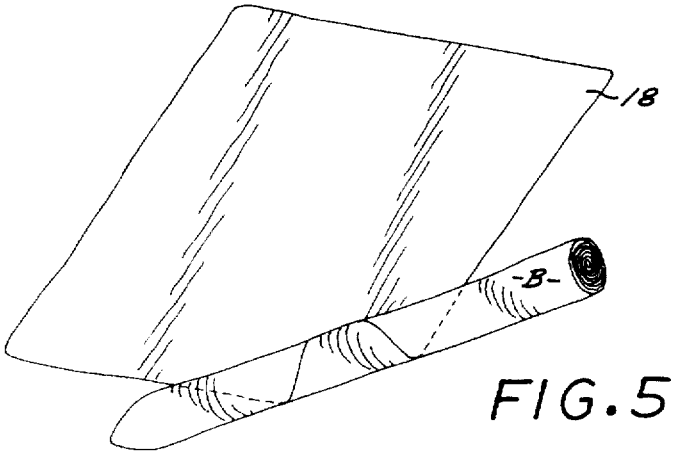
FIG. 5

LONG FILLER CIGAR CONSTRUCTION

FIELD OF THE INVENTION

The present invention relates to the construction of cigars.

BACKGROUND OF THE INVENTION

The term "long filler" tobacco has long been used to designate that the cigar is made of complete (or nearly complete) tobacco leaves, vis-a-vis, short chopped-up tobacco leaves. Long filler cigars command a significantly higher price than chopped-up type tobacco cigars, since long filler tobacco leaves burn smoother, and tobacco pieces do not tend to flake off in the smoker's mouth.

Traditionally, cigars are made of three separate sections. The radially inner section and the bulk of the cigar is called the filler. Generally in making fine cigars, the filler is gathered by hand in the approximate shape of the cigar and held together with a physically strong tobacco leaf termed the binder. The binder is usually a coarse tobacco which may be unpleasant in appearance. The binder is covered with a colorful tasty tobacco termed the wrapper. The wrapper color may be utilized to indicate the type of cigar, e.g., Colorado Claros (red), Maduras (black). Before or after the cigar is covered with wrapper, it may be placed in a mold so as to define the cigar's final shape. In this manner, a complete box of cigars can be provided wherein each cigar has approximately the same size, shape and color.

It is important to note that in making inexpensive cigars, the filler portion of the cigar usually comprises a plurality of cigar leaves of differing lengths. By way of example, see U.S. Pat. No. 435,510 issued Sep. 2, 1890. As shown in the drawings of such patent, the tobacco leaves are opened and flattened on a cigar maker's table, and a plurality of pieces of tobacco leaves of varying length are overlaid so as to form a bunch, beginning with a comparatively large tobacco leaf as a foundation, and adding thereon piece after piece, placed one on top of another of varying lengths in descending length. The plurality of long and short leaf tobacco pieces are then rolled together as indicated in FIG. 4 of such patent, and placed in a conventional mold so as to define the cigar's final shape.

After the cigar is removed from the mold and covered with the wrapper, to ensure the cigar is correctly sized, the front end is cut off with a very sharp knife blade in a cutter which is pre-set to cut off the cigar end at a desired length. The scrap remaining from the cut-off ends is used for short tobacco leaf use, such as inexpensive cigars and cigarettes. A typical, conventional cigar having its ends cut off in this manner is shown in U.S. Pat. No. 456,312 to Moonelis issued Jul. 21, 1891.

With cigars made by conventional methods utilizing short chopped-up pieces of tobacco, such pieces flake off the cigar in the smoker's mouth so as to detract from the smoker's pleasure. Additionally, cigars made with shorter pieces of tobacco usually do not burn as smoothly as cigars made entirely of long filler tobacco. Heretofore, it had not been possible by inspection to confirm that a cigar is of a high quality, utilizing solely long filler tobacco without cutting the cigar open.

SUMMARY OF INVENTION

The present invention provides a cigar construction that permits a simple, but very effective manner of immediately informing a purchaser that a cigar is made completely of long filler tobacco leaves, rather than utilizing short pieces of tobacco leaves. This object is accomplished by having the ends of the leaves protrude from the normally cut end of the cigar to permit immediate visual perception that the filler, binder and wrapper are all formed of long leaf tobacco leaves. Moreover, the smoker can actually pull on the protruding leaf ends to test that the tobacco leaves are of long filler type firmly held in place. The smoker can also recognize the uniform color of the filler in that way.

BRIEF DESCRIPTION OF THE DRAWINGS

FIG. 1 is a perceptive view of a long filler cigar made in accordance with a preferred embodiment of the present invention;

FIG. 2 is a cross-sectional view taken in enlarged scale along 2—2 of FIG. 1;

FIG. 3 is a vertically exploded perspective view showing a plurality of long filler tobacco leaves utilized in the fabrication of the cigar of FIGS. 1 and 2;

FIG. 4 is a perspective view showing how the long filler leaves of FIG. 3 are rolled together; and FIG. 5 is a perspective view showing how the rolled-together long filler leaves are contained within a wrapper.

DESCRIPTION OF A PREFERRED EMBODIMENT OF THE INVENTION

Referring to the drawings, there is shown in FIGS. 1 and 2 a cigar made in accordance with a preferred embodiment of the present invention utilizing a plurality of long filler tobacco pieces. A first step in making the cigar of FIGS. 1 and 2 is to vertically stack a plurality of such long filler tobacco pieces 10, 12 and 14 as shown in FIG. 3. It should be noted that each of the pieces 10, 12 and 14 are of generally uniform dimensions.

Referring to FIG. 4, the vertically stacked leaves 10, 12 and 14 of FIG. 3 are shown rolled together to define the body 16 of the cigar. In FIG. 5, the rolled-together leaves 10, 12 and 14 are rolled up within a conventional outside wrapper 18. Thereafter, the rolled-together leaves and wrapper are placed in a conventional mold (not shown) so as to define the finished cigar shown in FIGS. 1 and 2.

Referring to FIG. 1, it is important to note that the front end of the cigar is not cut off smoothly as in conventional cigar construction techniques. Instead, the front portion of the long filler leaves 10, 12 and 14 protrude from the front end of the cigar, as indicated at 20, to enable a smoker to observe that the binder and the wrapper are in fact long leaf tobacco pieces. Moreover, the smoker can actually pull forwardly on the protruding leaf ends to test that such leaf ends are of long filler type held firmly in place within the wrapper. This could not be accomplished where short lengths of tobacco leaves are incorporated into the construction of the cigar. By using the individual long leaves 10, 12 and 14, disposed parallel to one another, the cigar will burn evenly, with tobacco smoke being readily drawn through the cigar into the smokers mouth. It is also important to note that the unique appearance presented by the long filler tobacco ends which protrude from the front end of the cigar provides a bushy appearance which affords immediate smoker identification of the integrity of the long filler cigar construction of the present invention.

Various modifications and changes may be made without departing from the spirit of the present invention.

I claim:

1. A long filler cigar construction, comprising:

a plurality of vertically stacked long filler tobacco leaves of generally uniform dimensions which are rolled together within a binder to define the body of the cigar;

a wrapper within which is rolled said body; and with the front portion of the long filler tobacco leaves protruding from the front end of the wrapper so as to provide immediate smoker identification of the integrity of such long filler cigar construction.

2. A method of constructing a long filler cigar, comprising the steps of:

selecting a plurality of long filler tobacco leaves of generally uniform dimensions;

vertically stacking said leaves;

rolling said vertically stacked leaves together;

providing a wrapper; and rolling said wrapper about said rolled-together long filler tobacco leaves, with the front portion of the long filler tobacco leaves protruding from the front end of the wrapper to provide immediate smoker identification of the integrity of such long filler cigar construction.

* * * * *